US005984418A

United States Patent [19]

McInturff

[11] Patent Number: 5,984,418

[45] Date of Patent: Nov. 16, 1999

[54] ADJUSTABLE SEAT FOR WHEELCHAIRS

[75] Inventor: David A. McInturff, Akron, Ohio

[73] Assignee: Crown Therapeutics, Inc., Belleville, Ill.

[21] Appl. No.: 09/179,053

[22] Filed: Oct. 26, 1998

Related U.S. Application Data

[63] Continuation-in-part of application No. 08/847,702, Apr. 28, 1997.

[51] Int. Cl.[6] ..... A47C 7/02

[52] U.S. Cl. ..... 297/440.24; 297/440.22; 297/452.4; 297/DIG. 6; 297/452.2; 248/298.1

[58] Field of Search ..... 297/452.2, 452.4, 297/440.22, 440.2, 440.24, 252, DIG. 6; 248/205.2, 298.1, 200.1

[56] References Cited

U.S. PATENT DOCUMENTS

| | | | |
|---|---|---|---|
| 567,491 | 9/1896 | Murphy . | |
| 1,945,113 | 1/1934 | Kloboucnik . | |
| 2,534,009 | 12/1950 | Freasier et al. . | |
| 2,743,049 | 4/1956 | Flesher . | |
| 3,158,398 | 11/1964 | Stryker . | |
| 3,209,374 | 10/1965 | Walz . | |
| 3,220,767 | 11/1965 | Hendrickson . | |
| 3,821,825 | 7/1974 | Bailey . | |
| 4,114,327 | 9/1978 | Williams | 248/343 X |
| 4,365,840 | 12/1982 | Kehl et al. . | |
| 4,375,295 | 3/1983 | Volin . | |
| 4,398,766 | 8/1983 | Everett . | |
| 4,629,246 | 12/1986 | Fulton . | |
| 4,729,336 | 3/1988 | Rohne . | |
| 4,881,997 | 11/1989 | Hatch . | |
| 4,911,389 | 3/1990 | Self . | |
| 5,074,620 | 12/1991 | Jay et al. . | |
| 5,098,157 | 3/1992 | Surot . | |
| 5,115,529 | 5/1992 | White . | |
| 5,352,023 | 10/1994 | Jay et al. . | |
| 5,407,248 | 4/1995 | Jay et al. . | |
| 5,547,259 | 8/1996 | Frederick . | |
| 5,551,750 | 9/1996 | Yoshimura . | |
| 5,551,756 | 9/1996 | Gurasich et al. . | |
| 5,564,786 | 10/1996 | Peek et al. . | |
| 5,690,423 | 11/1997 | Hentz et al. | 248/343 X |
| 5,722,716 | 3/1998 | Thomas et al. | 297/452.2 X |
| 5,735,578 | 4/1998 | Penley | 297/DIG. 6 |

FOREIGN PATENT DOCUMENTS

| | | | |
|---|---|---|---|
| 1357265 | 2/1964 | France | 248/371 |
| 3203670 | 11/1983 | Germany . | |

*Primary Examiner*—Peter M. Cuomo
*Assistant Examiner*—David E. Allred
*Attorney, Agent, or Firm*—Howell & Haferkamp, L.C.

[57] ABSTRACT

A size-adjustable wheelchair seat comprises a first size-adjustable frame member, a second size-adjustable frame member and a cross frame member. The first frame member extends generally in a longitudinal direction. The first frame member includes a first penetrating frame element and a first receiving frame element. An end of the first penetrating frame element is telescoped within an end of the first receiving frame element. The second frame member is spaced laterally from and extends generally parallel to the first frame member. The second frame member includes a second penetrating frame element and a second receiving frame element. An end of the second penetrating frame element is telescoped within an end of the second receiving frame element. The cross frame element extends between the first frame member and the second frame member. The cross frame element comprises a first generally tubular sleeve portion, a second generally tubular sleeve portion and an elongate body extending between the first and second sleeve portions. The first sleeve portion is adapted to surround the first frame member. The second sleeve portion is adapted to surround the second frame member. The first and second sleeve portions are slidable longitudinally along the first and second frame members, respectively.

15 Claims, 6 Drawing Sheets

ADJUSTABLE SEAT FOR WHEELCHAIRS

This Application is a continuation-in-part of co-pending application Ser. No. 08/847,702 entitled "Size-Adjustable Load Supporting Device For Wheelchairs", filed Apr. 28, 1997.

BACKGROUND OF THE INVENTION (1) Field of the Invention

The present invention pertains to a load supporting device for use with conventional wheelchair frames. More particularly, the present invention pertains to a wheelchair seat which is adjustable to fit most conventional wheelchair frames and to accommodate different sized wheelchair patients.

(2) Description of the Related Art

In a conventional wheelchair, a soft "sling" type seat is suspended between spaced apart rails of the wheelchair frame for supporting the weight of the wheelchair user. However, these soft "sling" type wheelchair seats can aggravate many of the health problems suffered by wheelchair users.

Persons who use wheelchairs for extended periods of time may require the use of inflatable wheelchair seat cushions to prevent the formation of decubitus ulcers. Inflatable wheelchair cushions, such as the one disclosed in co-assigned U.S. Pat. No. 5,561,875, serve to distribute the weight of the supported body evenly over the area of the body that is in contact with the cushion. The inflatable cushions are generally placed on top of the wheel chair seat. However, the effectiveness of such inflatable cushions is significantly diminished by the curved configuration of a conventional "sling" type wheelchair seat. Moreover, by stacking an inflatable cushion on top of the "sling" seat, the effective seat height is raised an amount equal to the thickness of the inflatable cushion. This may result in the patient not being able to properly reach the foot plates of the wheelchair. It also raises the center of gravity of the patient.

Attempts have been made to replace the "sling" type wheelchair seat with a flat, rigid seat base which can be suspended low enough between the spaced apart rails of the wheelchair frame to accommodate the thickness of an inflatable cushion. For example, U.S. Pat. No. 4,629,246 of Fulton discloses a rigid wheelchair seat base which is hook mounted onto a wheelchair frame. The seat base can be easily removed to facilitate collapsing of the wheelchair for transportation and storage. However, the seat base disclosed in the Fulton patent is not, under normal circumstances, size-adjustable. Consequently, the seat base must be custom constructed for each individual wheelchair and wheelchair user. This can become expensive, even for a single wheelchair user who may require different seat bases as his or her physical needs change over time.

More recently, attempts have been made to provide size-adjustable wheelchair seat bases which can be adjusted to fit a variety of wheelchair frames and to accommodate the current and changing needs of the wheelchair user. For example, U.S. Pat. No. 5,074,620 of Jay et al. discloses a wheelchair seat base which may be adapted to fit a variety of wheelchair frames and which is adjustable to fit different sized users. However, the means for adjusting the length and width of the seat are quite cumbersome and require the use of tools to accomplish any size adjustment. Moreover, the size-adjustment means are rather limited with the seat base being capable of only a few different sizes.

Another problem that arises when using rigid seat bases that are suspended between the spaced apart rails of the wheelchair frame is limited vertical adjustability. As discussed above, in many circumstances, a patient requires an inflatable wheelchair seat cushion to be placed on top of the wheel chair seat. This requires the that the seat base be suspended lower between the spaced apart rails of the wheelchair frame in order to maintain the same effective seat height. However, in many prior art wheelchair seat structures, the seat base can only be lowered a short distance before the seat base and/or the frame structure that supports the seat base intersect the cross braces or "struts" of the wheelchair frame. Attempts have been made to overcome this problem by providing slots or cut-outs in the seat base or panel to accommodate the presence of such cross braces or "struts". For example, U.S. Pat. No. 4,629,246 of Fulton discloses a wheelchair seat with a rigid base having a pair of slots cut into the side edges of the base plate to accommodate the struts of the wheelchair frame on which the seat is mounted.

SUMMARY OF THE INVENTION

It is an object of this invention to provide a size-adjustable load supporting device for wheelchairs which may be quickly and easily adjusted, without tools, to fit most conventional wheelchair frames and to accommodate most wheelchair users. It is also an object of this invention to provide a device that, while being easily size-adjustable, provides sound mechanical support for the wheelchair user. Still another object is to provide a load supporting device capable of being mounted to a conventional wheelchair frame at a variety of angles to achieve various therapeutically significant functions. A further object of this invention is to provide a size-adjustable load supporting device which may be retrofitted onto the majority of existing conventional wheelchairs, or which can be used as original equipment on new wheelchairs. Yet another object of this invention is to provide a load supporting device having a frame structure with moveable cross frame elements adapted to accommodate for braces and support members of a conventional wheelchair frame without unduly limiting the vertical adjustability of the load supporting device.

In one embodiment of the invention, the support frame has a generally square configuration which is defined by four substantially T-shaped frame components which are mounted together. The T-shaped frame components are dimensioned to slidably nest with one another at a range of spaced apart distances. Some of the components are penetrating components and others are receiving components which are configured for telescoping reception of the penetrating components. The spaced apart distances of the frame components relative to one another therefore depends upon the degree of nesting or telescoping of the components.

By varying the amount of nesting or telescoping of the T-shaped frame components, the support frame can be quickly and easily adjusted to a number of lengths and widths. Thus, the support frame is size-adjustable to fit most conventional wheelchair frames and to accommodate wheelchair patients of various sizes. As the physical needs of the wheelchair user change, the device can be size-adjusted to accommodate those needs. The T-shaped frame components may include spring biased detent mechanisms for preventing the frame components from being inadvertently unnested during adjustment of the support frame.

The size-adjustable load supporting device includes a load supporting panel which is removably fastened to the support frame. The load supporting panel serves two primary functions. First, when fastened to the support frame, the panel secures the four T-shaped components at a desired spaced apart distance from one another to thereby define a length and depth of the support frame. Second, the panel serves to support the weight of the wheelchair patient.

Preferably, the load supporting panel is removably fastened to the size-adjustable support frame with a suitable hook and loop fastener, such as VELCRO®. The "loop" part of the hook and loop fastener covers substantially the entire bottom surface of the panel. The "hook" part of the hook and loop fastener covers at least a portion of the size-adjustable support frame. Preferably, at least a portion of each frame component with be covered on a top surface with the "hook" part of the fastener. Thus, when fastened to the support frame, the panel secures the positions of the frame components relative to one another to thereby define a rigid wheelchair support having a desired length and width.

The size-adjustable load supporting device of the present invention can be used to replace the conventionally used "sling" type wheelchair seat by mounting the system substantially horizontally between the spaced apart rails of a conventional wheelchair frame. Alternatively, the same device can be mounted substantially vertically on a conventional wheelchair frame so that the load supporting panel is used as a back rest for the wheelchair user.

The size-adjustable load supporting device includes four substantially J-shaped mounting brackets for mounting the device to a conventional wheelchair frame, one of the J-shaped brackets being connected to each of the T-shaped frame components. The hook portion of the "J" is adapted for engaging the spaced apart rails of a conventional wheelchair so that the load supporting panel of the device is suspended between the spaced apart rails.

Preferably, each J-shaped mounting bracket includes a plurality of laterally extending slots through which bolts, or other mechanical fasteners, slidably and rotatably connect the bracket to the extended segments of the support frame. Each bracket is therefore slidably and rotatably adjustable relative to the support frame. In an alternative embodiment, each bracket includes a longitudinally extending slot through which a bolt, or other mechanical fastener, slidably connects the bracket to the support frame.

Each of the J-shaped brackets is independently adjustable, slidably and rotatably, to thereby allow the device to be mounted to a conventional wheelchair frame at a variety of angles to achieve various therapeutically significant functions. For example, when the device is used as a seat base, the mounting brackets can be adjusted to provide a forward or rearward tilt to the seat base, or to create a tilt to one side or the other.

Front and rear locking clips are used to prevent the J-shaped mounting brackets from sliding along the rails of the wheelchair frame. Front locking clips are attached to the rails to prevent the front mounting brackets from sliding forwardly and prevent the device from moving out of position. Rear locking clips are attached to the rails behind the rear mounting brackets to prevent them from sliding rearwardly. The rear locking clips each include a tongue which is placed over the top of the hook portion of the rear mounting brackets to prevent the hook portion of the rear mounting brackets from inadvertently disengaging the rails.

In another aspect of the invention, a size-adjustable wheelchair seat comprises a first size-adjustable frame member, a second size-adjustable frame member and a cross frame member. The first size-adjustable frame member extends generally in a longitudinal direction and includes a first penetrating frame element and a first receiving frame element. An end of the first penetrating frame element is telescoped within an end the first receiving frame element. The second size-adjustable frame member is spaced laterally from and extends generally parallel to the first size-adjustable frame member. The second size-adjustable frame member includes a second penetrating frame element and a second receiving frame element. An end of the second penetrating frame element is telescoped within an end the second receiving frame element. The cross frame element extends laterally between the first and second size-adjustable frame members and is moveable longitudinally along the frame members.

In yet another aspect of the invention, a adjustable wheelchair seat comprises a first frame member, a second frame member and a cross frame member. The first frame member extends generally in a longitudinal direction. The second frame member is spaced laterally from and extends generally parallel to the first frame member. The cross frame element extends laterally between the first frame member and the second frame member. The cross frame element comprises a first generally tubular sleeve portion, a second generally tubular sleeve portion and an elongate body extending between the first and second sleeve portions. The first sleeve portion extends around the first frame member, the second sleeve portion extends around the second frame member, and the first and second sleeve portions are slidable longitudinally along the first and second frame members, respectively.

While the principal advantages and features of the present invention have been described above, a more complete and thorough understanding and appreciation for the invention may be attained by referring to the drawings and description of the preferred embodiment which follow.

Figure 1:
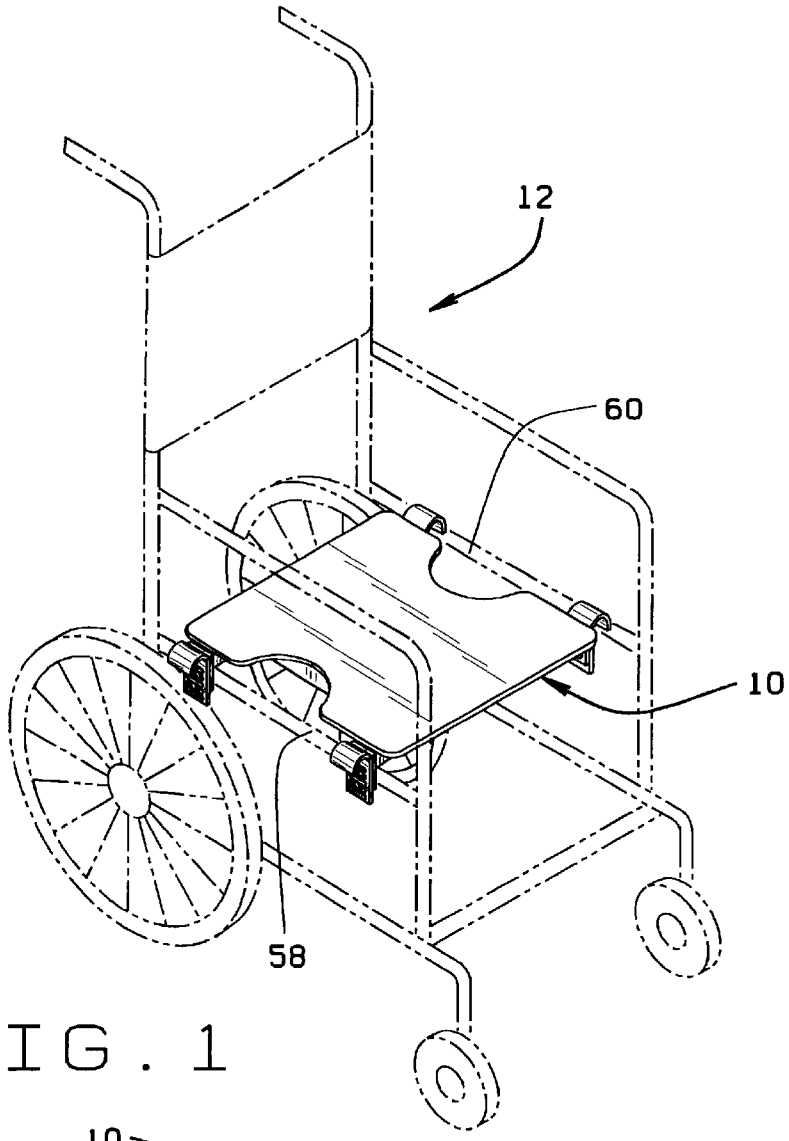
FIG. 1 is an isometric view of the size-adjustable load supporting device of the present invention being used as a seat base mounted to a conventional wheelchair frame (shown in phantom).

Reference numerals in these Figures correspond to reference numerals in the following detailed description.

DETAILED DESCRIPTION OF THE PREFERRED EMBODIMENTS

Figure 3:
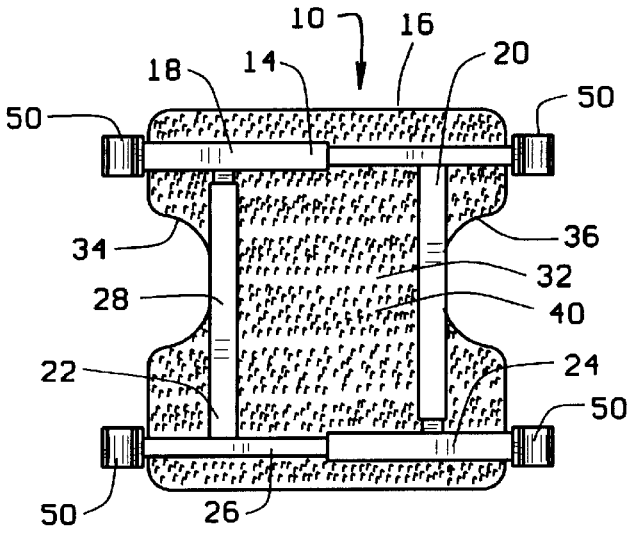
FIG. 3 is a bottom view of the size-adjustable load supporting device.
Figure 4:
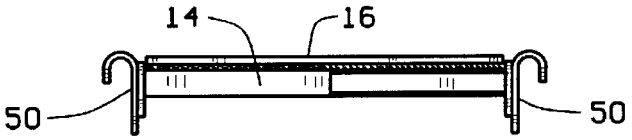
FIG. 4 is a front elevational view of the size-adjustable load supporting device.
Figure 5:
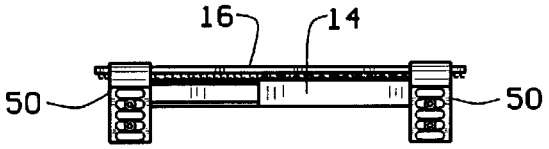
FIG. 5 is a side elevational view of the size-adjustable load supporting device.

The size-adjustable load supporting device of the present invention may be used with a conventional wheelchair frame. The device is shown generally as 10 in FIG. 1 in the environment of a conventional wheelchair, which is depicted in phantom as 12. As shown in FIG. 1, the device 10 is preferably used as a seat base in place of a conventional soft "sling" type wheelchair seat. As best shown in FIGS. 3–5, the size-adjustable load supporting device 10 is generally comprised of a size-adjustable support frame 14 and a load supporting panel 16 removably fastened to the support frame 14.

In the preferred embodiment of the present invention, the support frame 14 has a generally square configuration which, as shown in FIGS. 3, 6, 7 and 8, is defined by four substantially T-shaped frame components 18, 20, 22, 24 which are mounted together. The T-shaped frame components 18, 20, 22, 24 are preferably constructed from extruded aluminum tubing having a square cross section, but could be constructed from other materials which would function equivalently. The T-shaped frame components 18, 20, 22, 24 are dimensioned to slidably nest with one another at a range of spaced apart distances.

Figure 6:
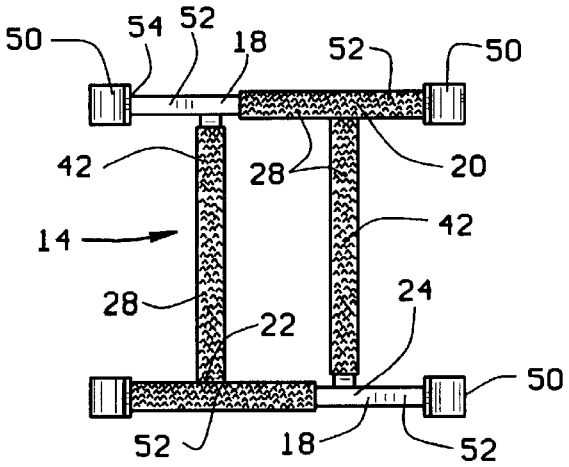
FIG. 6 is a top view of a variant embodiment of the device, shown with the load supporting panel removed and with the support frame components fully nested with one another.
Figure 7:
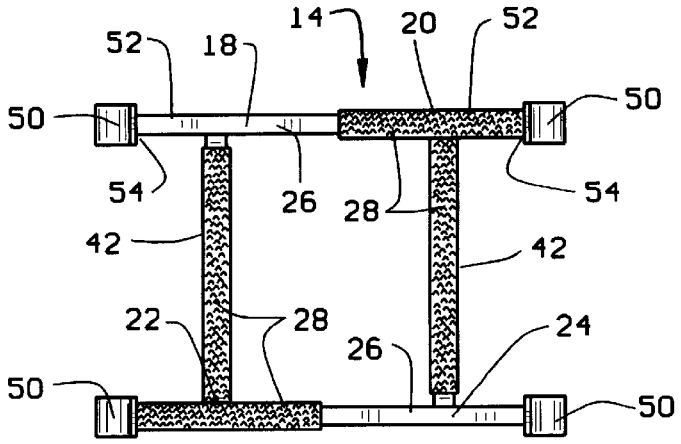
FIG. 7 is a top view of the device of FIG. 6, shown with the load supporting panel removed and with the amount of nesting in some of the support frame components adjusted to widen the support frame.
Figure 8:
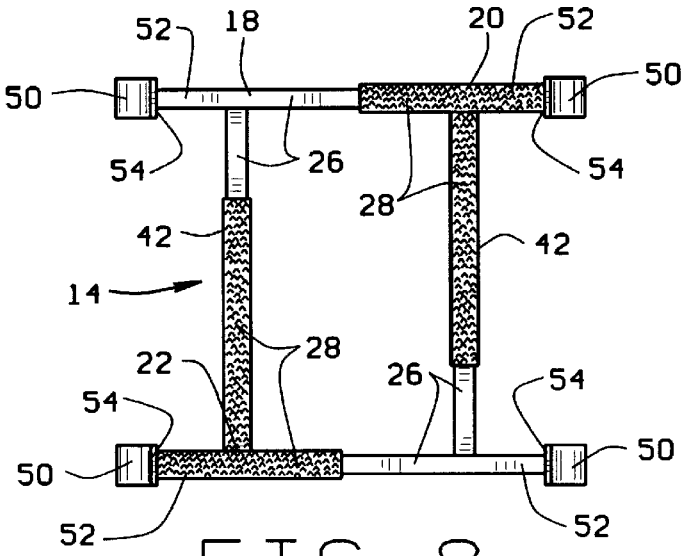
FIG. 8 is a top view of the device of FIG. 6, shown with the load supporting panel removed and with the amount of nesting in the support frame components adjusted to lengthen and widen the support frame.

Each T-shaped frame component is defined by two legs 26 or 28 which intersect to form a "T". As shown in FIGS. 6–8, some of the legs 26 are penetrating legs and other legs 28 are receiving legs. The penetrating legs 26 have a first cross-sectional dimension and the receiving legs 28 have a second cross-sectional dimension larger than the first cross-sectional dimension. Thus, the receiving legs 28 are configured for telescoping reception of the penetrating legs 26.

In FIGS. 6, 7 and 8, the support frame 14 is shown to include two T-shaped frame components 18, 22 comprised solely of receiving legs 28 and two T-shaped frame components 20, 24 comprised solely of penetrating legs 26. It is to be understood, however, that other configurations could be used without departing from the scope of this invention. For example, as shown in FIGS. 3–5, each T-shaped frame component could consist of one penetrating leg 26 and one receiving leg 28.

The spaced apart distances of the T-shaped frame components 18, 20, 22, 24 relative to one another depends upon the degree of nesting or telescoping of the components. By varying the amount of nesting or telescoping of the components 18, 20, 22, 24 the support frame 14 can be quickly and easily adjusted to a number of lengths and widths. Thus, the support frame 14 is size-adjustable to fit most conventional wheelchair frames and to accommodate wheelchair patients of various sizes.

In FIG. 6, the support frame 14 is shown with the T-shaped frame components 18, 20, 22, 24 fully nested with one another. FIG. 7 shows the support frame 14 with the amount of nesting adjusted laterally to widen the frame. FIG. 8 shows the support frame 14 with the amount of nesting adjusted both laterally and longitudinally to thereby lengthen and widen the frame.

The T-shaped frame components 18, 20, 22, 24 may employ spring biased detent mechanisms for preventing the frame components from being inadvertently unnested during adjustment of the support frame 14. Such detent mechanisms are well known in the art. Preferably, each receiving leg 28 includes a detent hole (not shown) located near its distal end, and each penetrating leg 26 includes a spring biased detent pin (not shown) near its distal end. The detent hole is configured to receive the detent pin when the detent pin and detent hole are aligned with one another. When the penetrating leg 26 and receiving leg 28 are adjusted relative to one another so that the detent pin is aligned with the detent hole, the detent pin springs into a locked position. The detent pin can be moved back to the unlocked position by manually depressing the pin against the spring bias. In the unlocked position, the detent pin is free to slide along an interior surface of the receiving leg 28. It is to be understood that locking means other than the spring bias detent mechanism described above may be employed to preventing inadvertent unnesting of the frame components.

Figure 2:
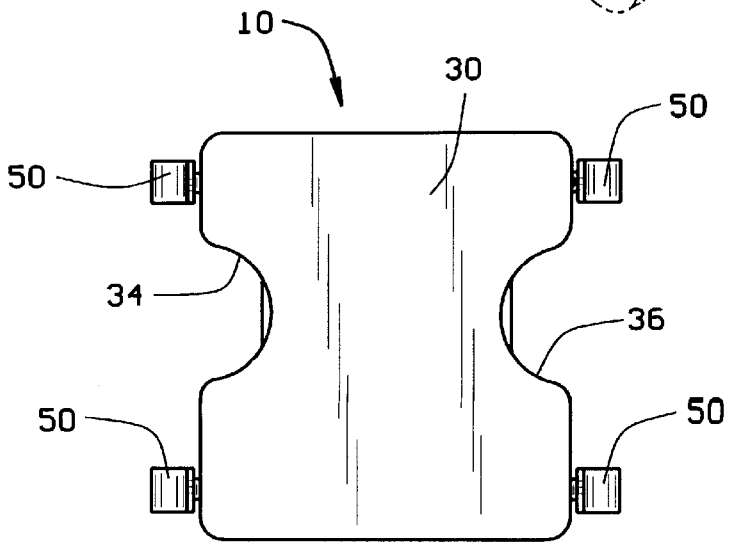
FIG. 2 is a top view of the size-adjustable load supporting device.

As best shown in FIGS. 2 and 3, the device 10 includes a load supporting panel 16 having a generally square shape. The panel 16 has a top surface 30 and a bottom surface 32 and includes two laterally opposite cut-outs 34, 36 which allow for various configurations of wheelchair cross bars.

The load supporting panel 16 is removably fastened to the support frame 14. When fastened to the support frame 14, the panel 16 fixes the four T-shaped components 18, 20, 22, 24 at a desired spaced apart distance from one another to thereby define a fixed length and depth of the support frame 14. The panel 16 also serves as a durable, lightweight seat capable of accommodating the weight of the majority of wheelchair patients. Preferably, the panel 16 is made of acrylonitrile butadiene styrene resin (commonly referred to as ABS) or a composite equivalent, but could be constructed from any durable, lightweight material which resists bowing and rotting.

In the preferred embodiment, the load supporting panel 16 is removably fastened to the size-adjustable support frame 14 with a suitable hook and loop fastener, such as VELCRO®. The "loop" part 40 of the hook and loop fastener covers substantially the entire bottom surface 32 of the panel 16. The "hook" part 42 of the hook and loop fastener covers portions of the size-adjustable support frame 14. It is to be understood that the roles of the "hook" and "loop" parts could be reversed without departing from the scope of this invention. It is also to be understood that means other than a hook and loop fastener could be used for removably fastening the panel 16 to the support frame 14. However, a hook and loop fastener is preferred because, among other things, it is relatively inexpensive and requires no tools of any kind.

To ensure that each frame component 18, 20, 22, 24 is properly secured with respect to the others, at least a portion of each receiving leg 28 should be covered with the "hook" part 42 of the fastener. Thus, when fastened to the support frame 14, the panel 16 secures the positions of the frame components 18, 20, 22, 24 relative to one another to thereby define a rigid wheelchair seat having a desired length and width which is fixed.

Figure 9:
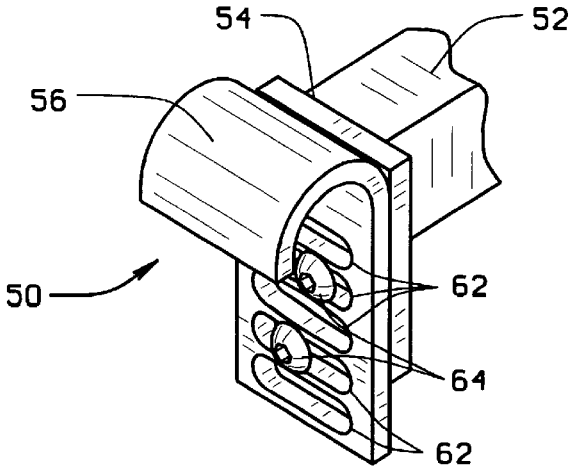
FIG. 9 is an isometric detail view of one of the J-shaped mounting brackets of the device.
Figure 10:
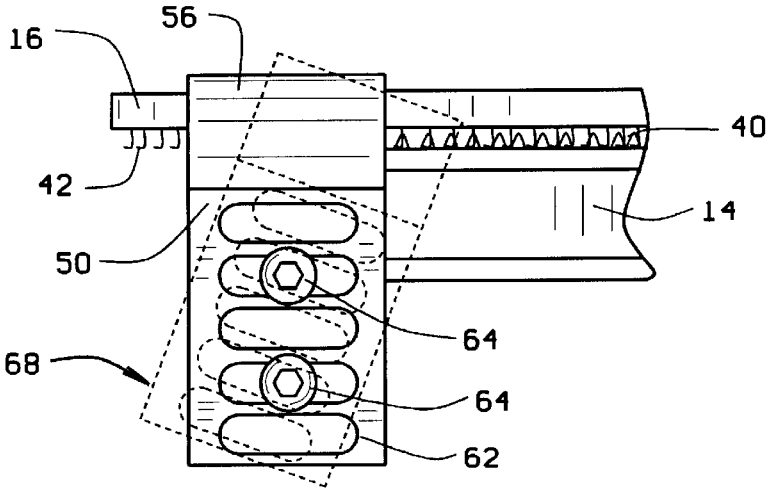
FIG. 10 is a side detail view of one of the J-shaped mounting brackets of the device, with an alternate rotated position of the bracket shown in phantom.

The size-adjustable load supporting device 10 includes four substantially J-shaped mounting brackets 50 for mounting the device 10 to a conventional wheelchair frame 12. FIGS. 9 and 10 show detailed views of the J-shaped mounting brackets 50. One of the brackets 50 is connected to each of the T-shaped frame components 18,20,22,24.

As described above, each of the T-shaped frame components 18, 20, 22, 24 is defined by two intersecting legs which define the "T". As shown in FIGS. 3, 6, 7 and 8, one leg of each "T" includes an extended segment 52 which extends out laterally beyond the intersection of the two legs. One J-shaped bracket 50 is connected to the distal end 54 of each extended segment 52.

The hook portion of the "J" 56 is adapted for engaging the spaced apart rails 58, 60 of a conventional wheelchair 12 so that the load supporting panel 16 of the device 10 is suspended between the spaced apart rails 58, 60. The hook portions 56 of the J-shaped brackets 50 are dimensioned to snap freely on to most standard rails 58, 60 and can be easily removed from the rails.

As best shown in FIGS. 9 and 10, each J-shaped mounting bracket 50 includes a plurality of laterally extending slots 62 through which bolts 64, or other mechanical fasteners, connect the bracket 50 to the extended segments 52 of the support frame 14. In the preferred embodiment, each bracket 50 includes five laterally extending slots 62 arranged in a vertical series to permit vertical adjustment of the device 10 relative to the wheelchair frame 12.

Each bracket 50 is laterally slidable relative to the support frame 14. Each bracket 50 is also rotatable relative to the support frame 14. FIG. 10 illustrates a rotated position 68 of the J-shaped bracket 50.

Figure 11:
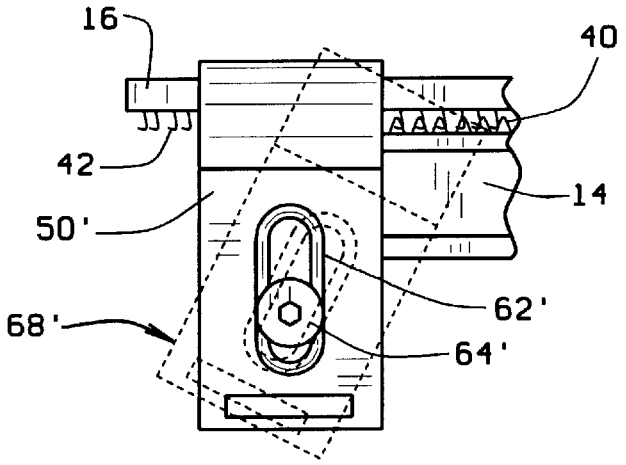
FIG. 11 is a side detail view of an alternate embodiment of the J-shaped mounting brackets of the device, with a rotated position of the bracket shown in phantom.

FIG. 11 illustrates an alternative embodiment of the J-shaped mounting bracket 50' including a longitudinally extending slot 62' through which bolt 64', or an equivalent mechanical fastener, slidably and rotatably connects the bracket 50' to the extended segments 52 of the support frame 14. FIG. 11 also shows a rotated position 68' of bracket 50'.

Each of the J-shaped brackets 50 and 50' is independently adjustable, slidably and rotatably, to thereby allow the device 10 to be mounted to a conventional wheelchair frame 12 at a variety of angles to achieve various therapeutically significant functions. For example, the mounting brackets 50 and 50' can be adjusted to tilt the user back in the chair to improve stability. As another example, the mounting brackets 50 and 50' on only one side of the device 10 could be raised to create a tilt to one side or the other.

As described above, the size-adjustable load supporting device of the present invention can be used to replace the conventionally used "sling" type wheelchair seat by mounting the device 10 substantially horizontally between the spaced apart rails 58, 60 of a conventional wheelchair frame 12. Also, if an inflatable wheelchair cushion (such as the one disclosed in co-assigned U.S. Pat. No. 5,561,875) is being used, the device 10 can be suspended low enough between the spaced apart rails of the wheelchair frame to accommodate for the thickness of the cushion.

Figure 12:
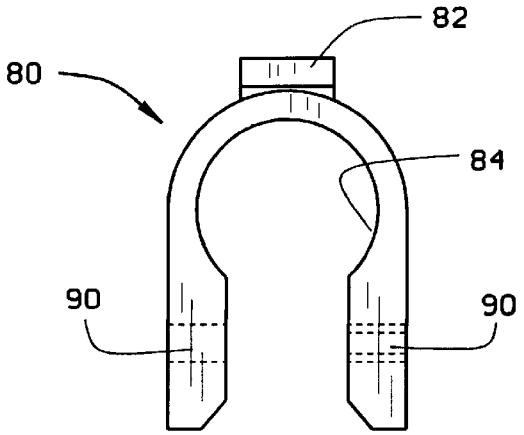
FIG. 12 is an end detail view of one of the horseshoe locking clips used in the present invention.

In the alternative use shown in FIG. 12, the same device 10 can be mounted substantially vertically on a conventional wheelchair frame 12 with the load supporting panel 16 being used as a back rest for the wheelchair user. When used as a back rest, the device may require mounting brackets other than the J-shaped mounting brackets 50 described above in order to keep from falling off of the back of the wheelchair frame 12. Selection of appropriate mounting brackets suitable for this alternative use of the device 10 would clearly be within the knowledge of one skilled in the art.

Figure 13:
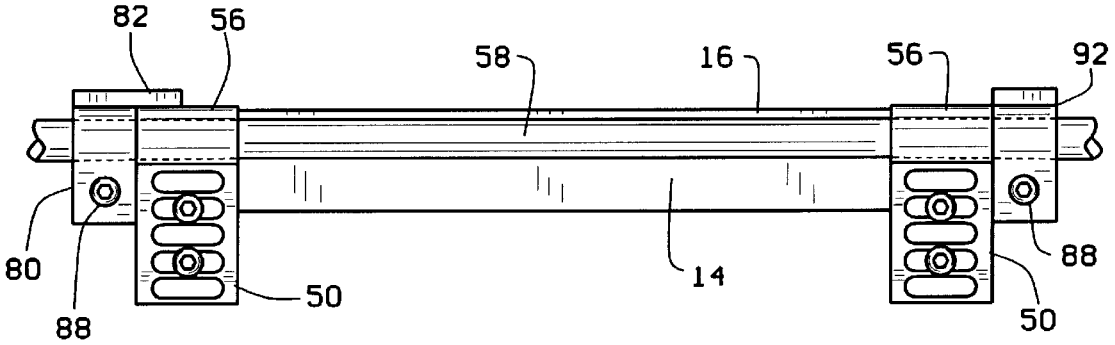
FIG. 13 is a side elevational view of the size-adjustable load supporting device mounted to the cross brace of a conventional wheelchair frame.

In the preferred embodiment of the present invention, front locking clips 92 and rear locking clips 92 are used to prevent the J-shaped mounting brackets 50 from sliding along rails 58 and 60 of the wheelchair frame 12. As shown in FIG. 13, a front locking clip 92 is attached to the rail 58 in front of the J-shaped mounting bracket 50. The front locking clip 92 prevents the mounting bracket 50 from sliding forwardly and prevents the device 10 from moving out of position. The front locking clip 92, however, does not prevent the mounting bracket 50 from being vertically disengaged from the rail 58. Therefore the device 10 may be snapped out so that the wheelchair may be collapsed for transportation and storage.

Figure 14:
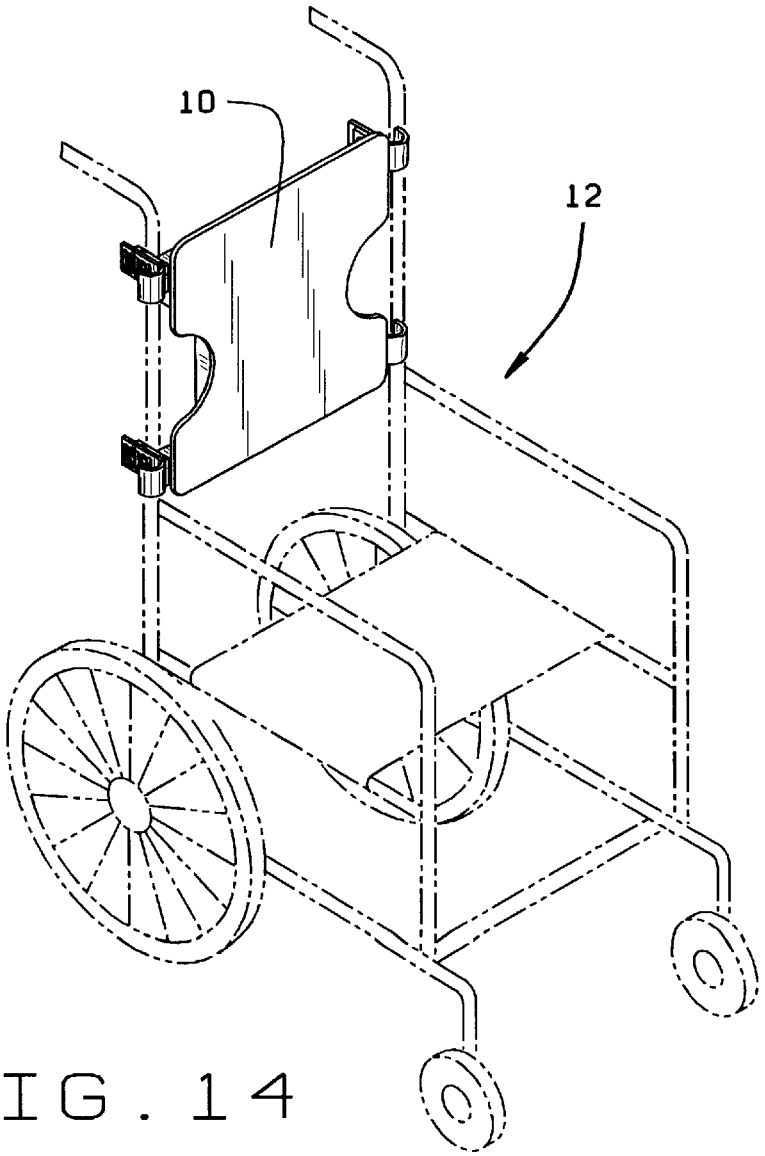
FIG. 14 is an isometric view of the size-adjustable load supporting device of the present invention being used as a back rest mounted to a conventional wheelchair frame (shown in phantom).

As shown in FIG. 13, the rear locking clip 80 may be attached to the back of the rail 58 behind the rear mounting bracket 50. The rear locking clip 80 includes a tongue 82 which may be placed over the top of the hook portion 56 of the mounting bracket 50. FIG. 14 shows an end detail view of the locking clip. The rear locking clip 80 prevents the mounting bracket 50 from sliding rearwardly, and the tongue 82 prevents the hook portion 56 of the mounting bracket 50 from inadvertently disengaging the rail 58.

Both locking clips 80 and 92 are mounted on rails 58 and 60 with bolts 88, or other equivalent mechanical fasteners. To mount the device 10 on the wheelchair frame 12, the hook portion 56 of the rear mounting brackets 50 are snapped onto the rails 58 and 60 and then slid back under the tongues 82 of the rear locking clips 80. The front mounting brackets 50 are then snapped onto the rails 58 and 60 immediately behind the front locking clips 92.

Figure 15:
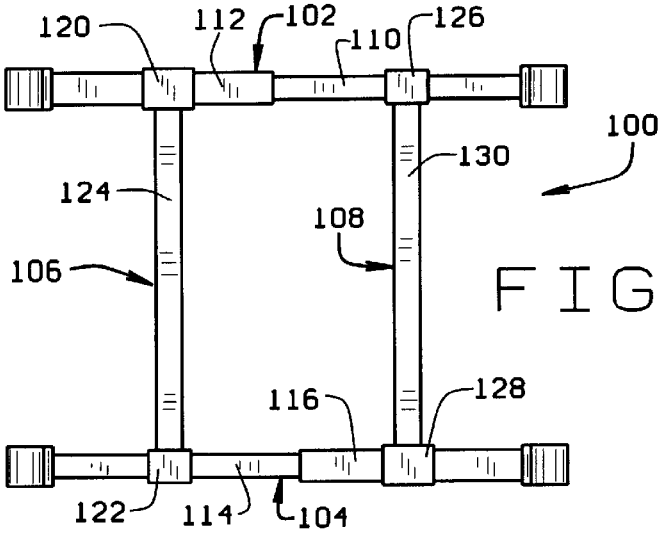
FIG. 15 is a top plan view of another embodiment of a support frame for a wheelchair seat having slidable cross beam elements.

FIG. 15 is a top plan view of another embodiment of a support frame 100 for a wheelchair seat. Except as described below, the support frame is similar in all respects to the support frame 14 described above. The support frame 100 has a generally square configuration defined by a first size-adjustable frame member 102 which extends generally in a longitudinal direction, a second size-adjustable frame member 104 spaced laterally from and extending generally parallel to the first size-adjustable support frame member 102, a first cross frame element 106 and a second cross frame element 108. The first size-adjustable frame member 102 includes a first penetrating frame element 110 and a first receiving frame element 112. The first receiving frame element 112 is dimension for telescoping reception of the first penetrating frame element 110. As shown in FIG. 15, an end of the first penetrating frame element 110 is telescoped within an end of the first receiving frame element 112. The second size-adjustable frame member 104 includes a second penetrating frame element 114 and a second receiving frame element 116. Like the frame elements of the first size-adjustable frame member, the second receiving frame element 116 is dimension for telescoping reception of the second penetrating frame element 114 and, as shown in FIG. 15, an end of the second penetrating frame element 114 is telescoped within an end of the second receiving frame element 116. By adjusting the amount of telescoping, the width of the support frame can be adjusted.

The cross frame elements 106 and 108 extend between the first size-adjustable frame member 102 and the second size-adjustable frame member 104 and, as shown in FIG. 15, are preferably generally perpendicular to the first and second size-adjustable support frame members 102 and 104. As described below more fully, the cross frame elements 106 and 108 are moveable longitudinally along the first and second size-adjustable frame members. Preferably, the cross frame elements 106 and 108 are moveable independently of one another. The longitudinal moveability of the cross frame elements 106 and 108 allows the support frame 100 to be adjusted to accommodate for the cross braces or "struts" of the wheelchair frame on which the wheelchair seat is mounted. This provides a greater range of vertical adjustability for the wheelchair seat.

The first cross frame element 106 includes a first generally tubular sleeve portion 120, a second generally tubular sleeve portion 122 and an elongate first body portion 124 extending between the first and second generally tubular portions 120 and 122. The second cross frame element 108 includes a third generally tubular sleeve portion 126, a fourth generally tubular sleeve portion 128 and an elongate second body portion 130 extending between the third and fourth generally tubular portions 126 and 128. Preferably, the first sleeve portion 120 is adapted to surround or circumscribe the first receiving frame element 112 of the first size-adjustable frame member 102, and the second sleeve portion 122 is adapted to surround or circumscribe the second penetrating frame element 114 of the second size-adjustable frame member 104. Also preferably, the third sleeve portion 126 is adapted to surround or circumscribe the first penetrating frame element 110 of the first size-adjustable frame member 102, and the fourth sleeve portion 128 is adapted to surround or circumscribe the second receiving frame element 116 of the second size-adjustable frame member 104. Thus, the first and third sleeve portions 120 and 126 are slidable longitudinally along the first size-adjustable frame member 102 and the second and fourth sleeve portions 122 and 128 are slidable longitudinally along the second size-adjustable frame member 104.

Figure 16:
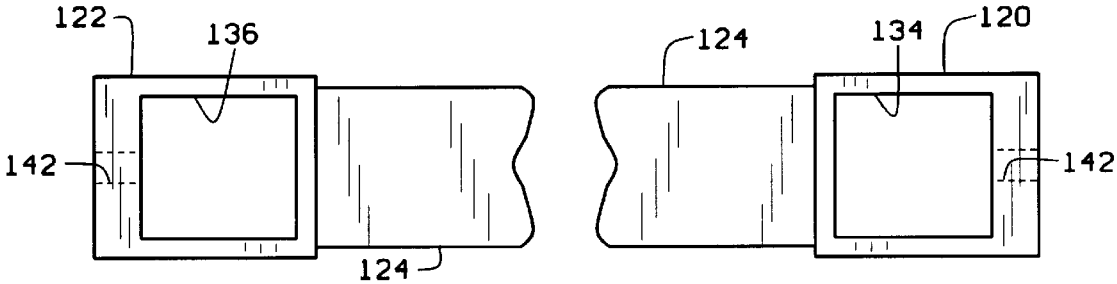
FIG. 16 is an enlarged, fragmented side elevation view of one of the slidable cross beam elements used in the support frame of FIG. 15.

FIG. 16 is an enlarged, fragmented side elevation view of the first cross frame element 106 (as viewed looking from right to left in FIG. 15). As shown in FIG. 16, the first sleeve portion 120 has an interior surface 134 configured to fit around an exterior surface of the first receiving frame element 112 of the first size-adjustable frame member 102. The second sleeve portion 122 has an interior surface 136 configured to fit around an exterior surface of the second penetrating frame element 114 of the second size-adjustable frame member 104. Similarly, the third sleeve portion 126 has an interior surface (not shown, but similar to the interior surface 136 of the second sleeve portion 122) configured to fit around an exterior surface of the first penetrating frame element 110 of the first size-adjustable frame member 102, and the fourth sleeve portion 128 has an interior surface (not shown, but similar to the interior surface 134 of the first sleeve portion 120) configured to fit around an exterior surface of the second receiving frame element 116 of the second size-adjustable frame member 104.

Figure 17:
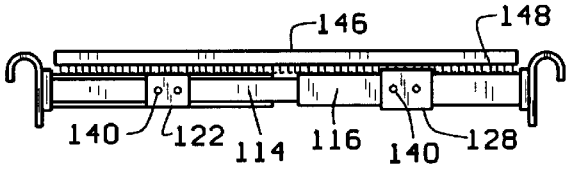
FIG. 17 is a front elevation view of the support frame of FIG. 15 with a load-supporting panel fastened thereto by hook and loop fasteners.

As shown in FIG. 17, the second sleeve portion 122 includes a pair of set screws 140 adapted for engagement with the exterior surface of the second penetrating frame member 114, and the fourth sleeve portion 128 includes a pair of set screws 140 adapted for engagement with the exterior surface of the second receiving frame member 116. The first and third sleeve portions include similar set screws (not shown) adapted for engagement with the exterior surfaces of the first receiving frame member 112 and the first penetrating frame member 110, respectively. Preferably, the set screws 140 are externally threaded and are in threading engagement with internally threaded through bores 142 in the sleeve portions 120, 122, 126 and 128. The set screws 140 are tightened to secure the cross frame elements 106 and 108 at selected longitudinal positions along the first and second size-adjustable frame members 102 and 104.

The embodiment of the wheelchair seat shown in FIGS. 15–17 further comprises a load supporting panel 146. The panel is similar in all respects to the panel 16 described above. Preferably, the panel 146 is removably fastened to the support frame 100 with a hook and loop fastener 148 in the same way that the panel 16 is removably fastened to the support frame 14 described above. One component (i.e., either the hook component or the loop component) of the hook and loop fastener is applied to a bottom surface of the panel 146 and the other component of the hook and loop fastener is applied to the upper surfaces of portions of the first size-adjustable frame member 102, second size-adjustable frame member 104, first cross frame element 106 and second cross frame element 108.

Thus, the panel 146 is adapted for securing the first and second cross frame elements 106 and 108 at selected longitudinal positions relative to one another and relative to the first and second size-adjustable frame members 102 and 104 when the panel 146 is fastened to the support frame 100. Similarly, the panel 146 serves to secure the penetrating and receiving frame elements of the first and second size-adjustable frame members 102 and 104 relative to one another. The panel can therefore serve as an alternative means for securing the components of the support frame 100 relative to one another, or can work together with the set screws to maintain the components of the support frame 100 in their desired relative positions.

Figure 18:
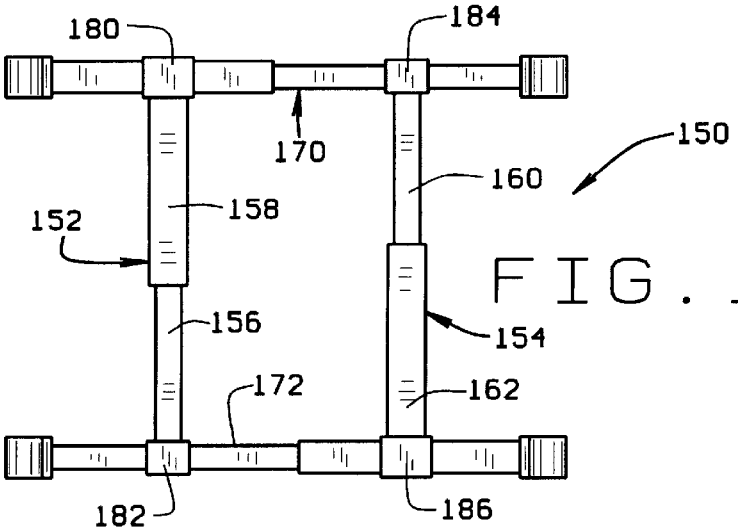
FIG. 18 is a top plan view of yet another embodiment of a support frame for a wheelchair seat having telescoping cross beam elements.

FIG. 18 is a top plan view of yet another embodiment of a support frame 150 having first and second size-adjustable cross frame elements 152 and 154. The first size-adjustable cross frame element 152 includes a third penetrating frame element 156 and a third receiving frame element 158, and the second size-adjustable cross frame element 154 includes a fourth penetrating frame 160 element and a fourth receiving frame element 162. As shown in FIG. 18, an end of the third penetrating frame element 156 is telescoped within an end the third receiving frame element 158, and an end of the fourth penetrating frame element 160 is telescoped within an end the fourth receiving frame element 162. The embodiment of FIG. 18 includes first and second size-adjustable frame members 170 and 172 that are similar in all respects to the embodiment of FIGS. 15–17. The embodiment of FIG. 18 also includes generally tubular sleeve portions 180, 182, 184 and 186 that are similar in all respects to the tubular sleeve portions 120, 122, 126 and 128 shown in FIGS. 15–17.

While the present invention has been described by reference to a specific embodiment and a particular use, it should be understood that other configurations could be constructed, and different uses could be made, without departing from the scope of the invention as set forth in the following claims.

What is claimed is:

1. A size-adjustable wheelchair seat comprising:

a first size-adjustable frame member extending generally in a longitudinal direction, the first size-adjustable frame member including a first penetrating frame element and a first receiving frame element, an end of the first penetrating frame element being telescoped within an end of the first receiving frame element;

a second size-adjustable frame member spaced laterally from and extending generally parallel to the first size-adjustable frame member, the second size-adjustable frame member including a second penetrating frame element and a second receiving frame elements, an end of the second penetrating frame element being telescoped will an end of the second receiving frame element; and first and second cross frame elements extending between and connected to each of the first and second size-adjustable frame members, each of the first and second cross frame elements being movably mounted to the first and second size-adjustable frame members in a manner to permit independent movement of each of the first and second cross frame elements relative to the first and second size-adjustable frame members.

2. The wheelchair seat of claim 1 further comprising a load supporting panel removably fastened to the first size-adjustable frame member, the second size-adjustable frame member, the first cross frame element and the second cross frame element, said panel being adapted for securing the first and second cross frame elements at selected longitudinal positions along the first and second size-adjustable frame members when said panel is fastened to the first and second size-adjustable frame members and the first and second cross frame elements.

3. The wheelchair seat of claim 2 wherein said panel is removably fastened to the first size-adjustable frame member, the second size-adjustable frame member, the first cross frame element and the second cross frame element with a hook and loop fastener.

4. The wheelchair seat of claim 1 wherein the first cross frame element includes a third penetrating frame element and a third receiving frame element, an end of the third penetrating frame element being telescoped within an end of the third receiving frame element, the second cross frame element including a fourth penetrating frame element and a fourth receiving frame element, an end of the fourth penetrating frame element being telescoped within an end of the fourth receiving frame element.

5. The wheelchair seat of claim 1 wherein the first cross frame element includes a first generally tubular sleeve portion, a second generally tubular sleeve portion and an elongate first body portion extending between the first and second sleeve portions, the second cross frame element including a third generally tubular sleeve portion, a fourth generally tubular sleeve portion and an elongate second body portion extending between the third and fourth sleeve portions, the first sleeve portion being adapted to surround the first size-adjustable frame member, the second sleeve portion being adapted to surround the second size-adjustable frame member, the third sleeve portion being adapted to surround the first size-adjustable frame member, the fourth sleeve portion being adapted to surround the second size-adjustable frame member, the first and third sleeve portions being slidable longitudinally along the first size-adjustable frame member and the second and fourth sleeve portions being slidable longitudinally along the second size-adjustable frame member.

6. The wheelchair seat of claim 5 wherein the first sleeve portion has an interior surface configured to fit around an exterior surface of the first receiving frame element of the first size-adjustable frame member, the second sleeve portion has an interior surface configured to fit around an exterior surface of the second penetrating frame element of the second size-adjustable frame member, the third sleeve portion has an interior surface configured to fit around an exterior surface of the first penetrating frame element of the first size-adjustable frame member, and the fourth sleeve portion has an interior surface configured to fit around an exterior surface of the second receiving frame element of the second size-adjustable frame member.

7. The wheelchair seat of claim 6 wherein the first, second, third and fourth sleeve portions each include at least one set screw adapted for engagement with the exterior surfaces of the first receiving frame element, second penetrating frame element, first penetrating frame element and second receiving frame element, respectively, in a manner for securing the first and second cross frame elements at a selected longitudinal positions.

8. An adjustable wheelchair seat comprising:

a first frame member extending generally in a longitudinal direction, the first frame member including a first penetrating frame element and a first receiving frame element, an end of the first penetrating frame element being telescoped within an end of the first receiving frame element;

a second frame member spaced laterally from and extending generally parallel to the first frame member, the second frame member including a second penetrating frame element and a second receiving frame element, an end of the second penetrating frame element being telescoped within an end of the second receiving frame element; and first and second cross frame elements extending between and slidably connected to the first and second frame members, each of the first and second cross frame elements comprising a first generally tubular sleeve portion, a second generally tubular sleeve portion and an elongate body extending between the first and second sleeve portions, the first sleeve portion of each cross frame element surrounding a respective portion of the first frame member, the second sleeve portion of each cross frame element surrounding a respective portion of the second frame member, the first and second sleeve portions of each cross frame element being independently slidable longitudinally along the first and second frame members, respectively.

9. The wheelchair seat of claim 8 wherein each first sleeve portion has an interior surface configured to fit around an exterior surface of the first frame member, each second sleeve portion having an interior surface configured to fit around an exterior surface of the second frame member.

10. The wheelchair seat of claim 9 wherein the first and second sleeve portions each include at least one set screw adapted for engagement with the exterior surface of the first and second frame members, respectively, in a manner for securing the cross frame element at a selected longitudinal position along the first and second frame members.

11. The wheelchair seat of claim 9 further comprising a load supporting panel removably fastened to the first frame member, the second frame member and the cross frame element, said panel being fastened to the first frame member the second frame member and at least one of the cross frame elements in a manner to secure said one of the cross frame elements at a selected longitudinal position along the first and second frame members when said panel is fastened to the first frame member, the second frame member and said one of the cross frame elements.

12. The wheelchair seat of claim 11 wherein said panel is removably fastened to the first frame member, the second frame member and said one of the cross frame elements with a hook and loop fastener.

13. The wheelchair seat of claim 9 wherein the first and second frame elements each have a generally square cross-sectional configuration, the first and second sleeve portions of each cross frame element each having a generally square cross-sectional configuration dimensioned to fit around the exterior surfaces of the first and second frame members, respectively.

14. The wheelchair seat of claim 8 wherein the first frame member, the second frame member, the first cross frame element and the second cross frame element together define a generally square seat frame, the wheelchair seat further comprising a load supporting panel removably fastened to the first cross frame element and the second cross frame element, said panel being fastened to the first and second cross frame elements in a manner to secure the first and second cross frame elements at selected longitudinal positions relative to one another when said panel is fastened to the first and second cross frame members.

15. The wheelchair seat of claim 8 wherein the first cross frame element includes a third penetrating frame element and a third receiving frame element, an end of the third penetrating frame element being telescoped within an end of the third receiving frame element, the second cross frame element including a fourth penetrating frame element and a fourth receiving frame element, an end of the fourth penetrating frame element being telescoped within an end of the fourth receiving frame element.

* * * * *